US005279048A

United States Patent [19]

Lawall et al.

[11] Patent Number: 5,279,048

[45] Date of Patent: Jan. 18, 1994

[54] HANDS FREE HAIR DRYER AND HAIR DRYER ACCESSORY

[75] Inventors: Lina A. Lawall, Cheshire; Robert R. Hellman, Jr., Oxford, both of Conn.

[73] Assignee: Intelligent Designs, Inc., Cheshire, Conn.

[21] Appl. No.: 749,264

[22] Filed: Aug. 23, 1991

[51] Int. Cl.[5] ..... F26B 19/00

[52] U.S. Cl. ..... 34/90; 34/96; 34/91; 34/97

[58] Field of Search ..... 34/90, 91, 96, 97, 98, 34/3

[56] References Cited

U.S. PATENT DOCUMENTS

| | | | |
|---|---|---|---|
| 2,306,100 | 12/1942 | Williams | 34/97 |
| 3,171,428 | 3/1965 | Bozeman | 34/90 |
| 3,384,977 | 5/1968 | Rosenberg | 34/90 |
| 3,449,838 | 6/1969 | Chancellor, Jr. | 34/90 |
| 3,724,092 | 4/1973 | McCleerey | 34/99 |
| 3,878,621 | 4/1975 | Duerre | 34/90 |
| 4,161,955 | 7/1979 | Webb | 34/90 |
| 4,642,909 | 2/1987 | Garcia | 34/97 |
| 4,653,201 | 3/1987 | Seaman | 34/90 |
| 4,691,451 | 9/1987 | Giorgis | 34/68 |
| 4,712,313 | 12/1987 | Gettleman | 34/97 |
| 4,914,273 | 4/1990 | Matsui | 219/222 |
| 4,972,607 | 11/1990 | Lagace | 34/91 |

*Primary Examiner*—Henry A. Bennet
*Assistant Examiner*—Denise L. Gromada
*Attorney, Agent, or Firm*—John H. Crozier

[57] ABSTRACT

In one preferred embodiments, a hands free hair dryer having a body in which are disposed a fan and a heating element, the body being mounted on a wall or the edge of a door. An infinitely positionable, self-supporting hose has a proximal end attached to the outlet of the body and a distal end selectively disposed to direct a stream of hot air toward the head of a user. Alternatively, the heating element may be disposed in the distal end of the hose. In another embodiment, the body is replaced with a housing within which the outlet nozzle of a conventional hand held air dryer is releasably secured.

9 Claims, 7 Drawing Sheets

HANDS FREE HAIR DRYER AND HAIR DRYER ACCESSORY

BACKGROUND OF THE INVENTION

1. Field of the Invention

The present invention relates to electric hair dryers generally and, more particularly, but not by way of limitation, to an electric hair dryer and to an accessory for an electric hair dryer which include infinitely positionable hoses for adjustably directing hot air toward the head of a user.

2. Background Art

Electric hair dryer are widely used devices for drying and styling the hair of users. Such a hair dryer typically includes a heating element, a fan, and means to direct hot air toward the head of a user.

Early hair dryers included a helmet-like fixture which fit around the head of the user and the user remained immobile while the user's hair dried. With changing hair styles, this type of dryer has mainly been replaced by hand held dryers which permit the user to hold the dryer in one hand and have the other hand fee to manipulate a comb or other styling tool. While this procedure is somewhat satisfactory, holding a dryer for long periods can be difficult and it is desirable, in some cases, for both hands of the user to be free for styling.

There have been some attempts to provide "hands free" hair dryers which are fixed in position or which have a conventional hair dryer mounted on adjustable arms. Such hair dryers are limited in utility, since the adjustability thereof is limited or difficult. Also, many of these are not readily transportable for use in hotel rooms or the like.

Accordingly, it is principal object of the present invention to provide a hands free hair dryer having infinitely adjustable air directing means.

It is an additional object of the invention to provide an accessory air directing means which is infinitely adjustable and which is used with a conventional hand held hair dryer.

It is a further object of the invention to provide such hair dryer and accessory that are easily and conveniently adjusted.

It is another object of the invention to provide such hair dryer and accessory that are easily and economically manufactured.

It is yet an additional object of the invention to provide such hair dryer and accessory that are compact and conveniently transported for temporary use in hotel rooms or the like.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in one preferred embodiment, a hands free hair dryer having a body in which are disposed a fan and a heating element, the body being mounted on a wall or the edge of a door. An infinitely positionable, self-supporting hose has a proximal end attached to the outlet of the body and a distal end selectively disposed to direct a stream of hot air toward the head of a user. Alternatively, the heating element may be disposed in the distal end of the hose. In another embodiment, the body is replaced with a housing within which the outlet nozzle of a conventional hand held air dryer is releasably secured.

BRIEF DESCRIPTION OF THE DRAWING

Understanding of the present invention and the various aspects thereof will be facilitated by reference to the accompanying drawings figures, provided for purposes of illustration only and not intended to define the scope of the invention, in which.

DETAILED DESCRIPTION OF THE PREFERRED EMBODIMENTS

Figure 1:
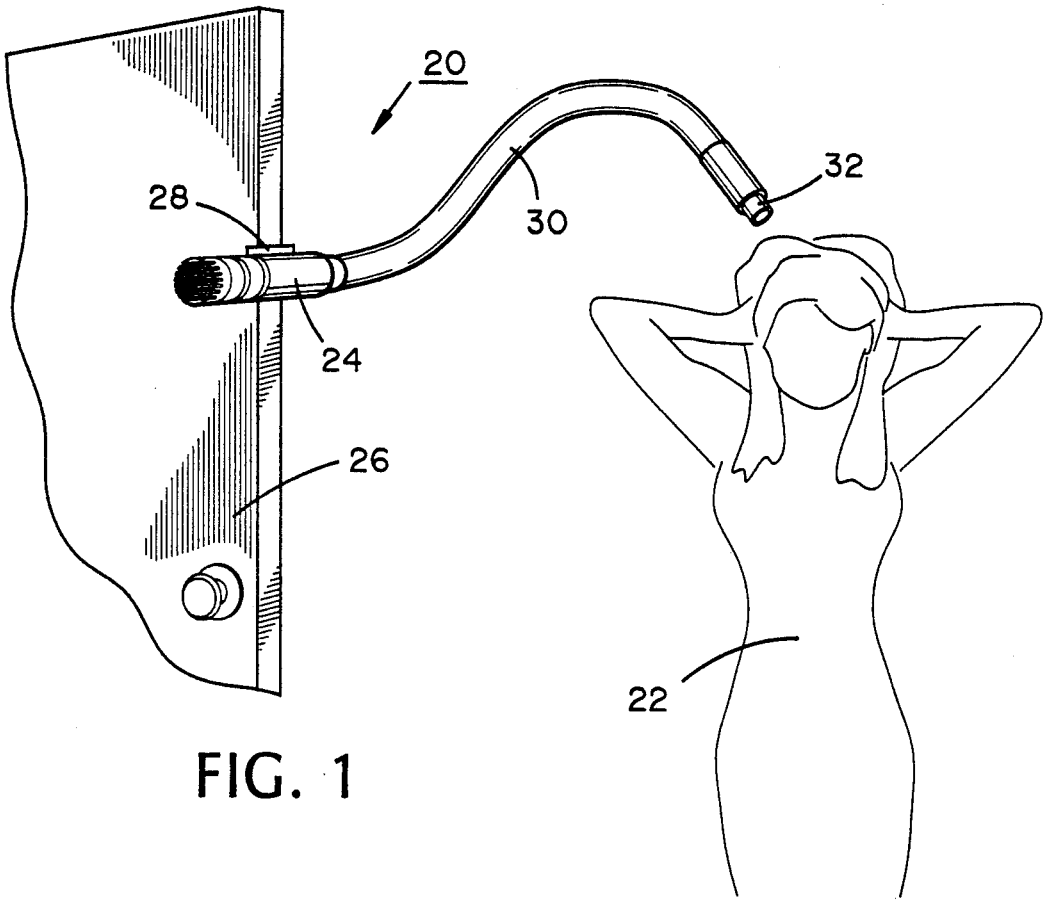
FIG. 1 is a perspective view showing one embodiment of the present invention in use.

Reference should now be made to the Drawing in which similar or identical elements are given consistent identifying numerals throughout the various figures thereof, and in which parenthetical references to figure numbers direct the reader to the view(s) in which the element(s) being described is (are) best seen, although the element(s) may be seen also in other views.

FIG. 1 illustrates a hair dryer according to one embodiment of the present invention, generally indicated by the reference numeral 20 being used by a person 22. Hair dryer 20 includes a body 24 which is mounted to a door 26 by means of a clamp 28 and further includes an infinitely positionable, self-supporting hose 30 which permits person 22 to selectively direct a flow of hot air from an end fitting 32 at the distal end of the hose towards the person's head while the person has both hands free for combing and/or styling the person's hair.

As used herein and in the appended claims, "infinitely positionable, self-supporting hose" means a hose which, when one end of the hose is attached to an immobile object, the free end of the hose can be moved to, and left in, any desired position without further support for the hose or for the free end.

Figure 2:
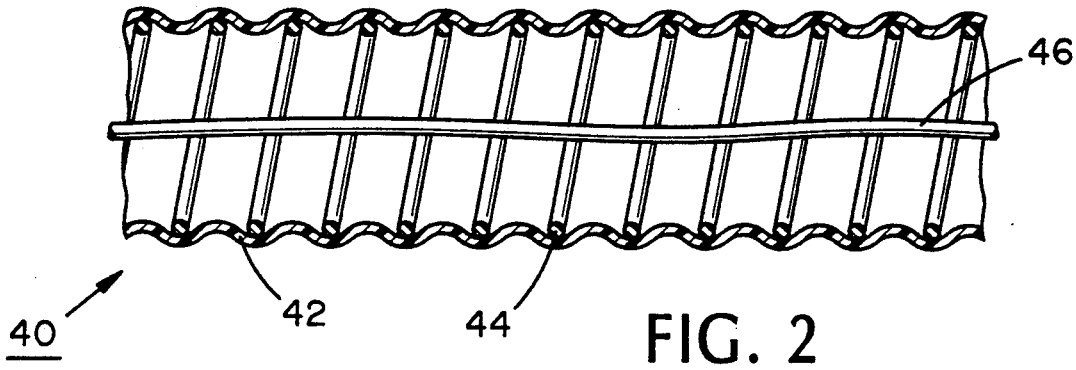
FIG. 2 is a side elevational view, partially in cross-section, of one type of infinitely positionable, self-supporting hose of the present invention.
Figure 3:
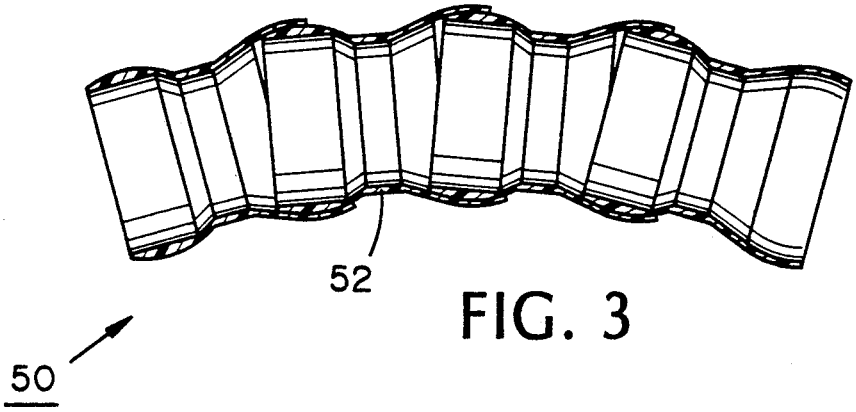
FIG. 3 is a side elevational view, in cross-section, of another type of infinitely positionable, self-supporting hose.
Figure 4:
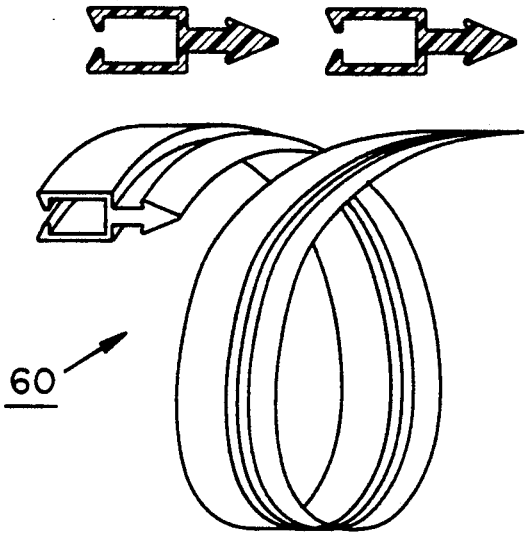
FIG. 4 contains exploded perspective and cross-sectional views of yet another type of infinitely positionable, self-supporting hose.

FIGS. 2–4 show alternative constructions for hose 30 of FIG. 1.

On FIG. 2, a hose, generally indicated by the reference numeral 40, includes a flexible plastic skin 42 with an internal, helical wire 44 supporting the skin. The skin and wire of hose 40 are not self-supporting, but the hose further includes a relatively rigid, but bendable, annealed stainless steel rod disposed within the hose and extending between body 24 (FIG. 1) and end fitting 32 (FIG. 1) which makes the hose self-supporting. Such a hose is similar to that furnished by Flexaust, Amesbury, Mass.

On FIG. 3, a hose, generally indicated by the reference numeral 50, comprises a plurality of snapped together, injection molded links, such as link 52, rotatably attached to each other in a ball-and-socket relationship, the interference fit of the balls and sockets together with the frictional characteristics of the acetal copolymer material providing sufficient frictional resistance that the hose is self-supporting. One advantage of hose 50 is that the hose can be provided in several short sections which the user would snap together to form the desired length. Such a hose is similar in concept to the Loc-Line hose furnished by Lockwood Products, Inc., Lake Oswego, Oreg.

On FIG. 4, a hose generally indicated by the reference numeral 60 comprises an extruded plastic section the edges of which are interlockable to form a flexible hose. Such a hose is similar in concept to the Pliaduct hose furnished by Dayco Products, Inc., Dayton, Ohio.

Hoses 40, 50, and 60 may include radial or axial standoff fins and/or be encased in a fabric, foam, or similar material to reduce the risk of user contact with the hot exterior of the hoses.

Figure 5:
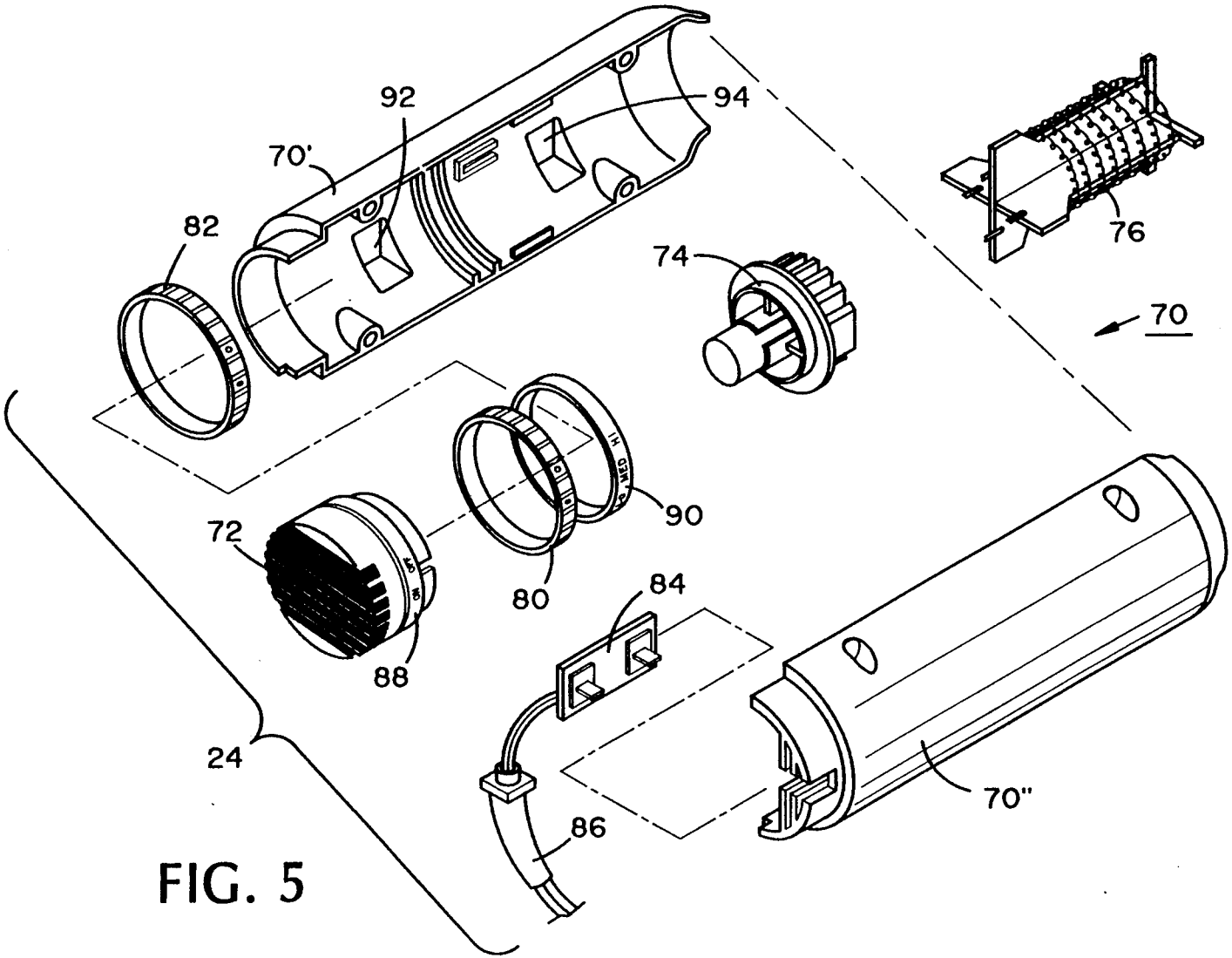
FIG. 5 is an exploded perspective view of the body of the embodiment of FIG. 1.

Referring now to FIG. 5, body 24 of hair dryer 20 (FIG. 1) includes a generally cylindrical, injection molded plastic housing 70 formed by body halves 70' and 70'', having an inlet air grill 72 at the distal end thereof. Coaxially aligned along the major axis of housing 70 are a motor/fan assembly 74 and an heating element/thermal cutoff 76 to provide a flow of hot air from the proximal end of the housing to hose 30 (FIG. 1). "ON/OFF" control ring 80 and "LO/MED/HI" control ring 82 operatively engage a switch/control 84 which provides electric power to motor/fan assemble 74 and heating element/thermal cutoff 76 from a power cord 86 which may be connected to a conventional wall outlet (not shown). A first spacer ring 88 is disposed between inlet air grill 72 and control ring 80 and a second spacer ring 90 is disposed between control ring 80 and control ring 82. Formed integrally with body half 70' are bracket members 92 and 94.

Figure 6:
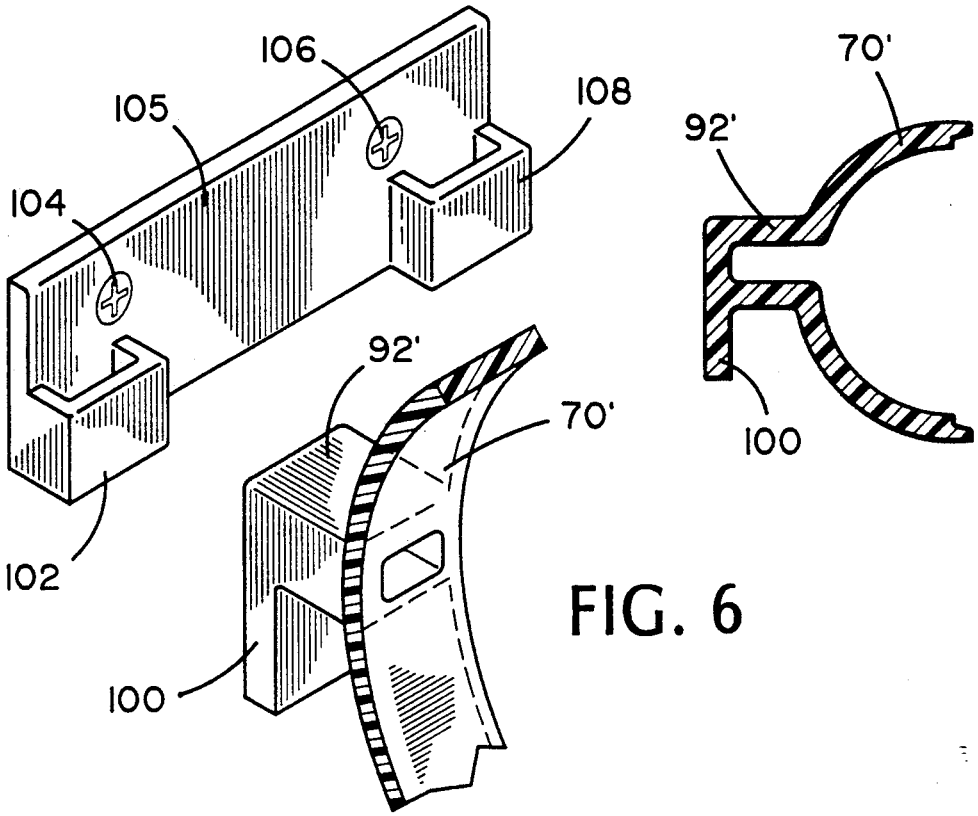
FIG. 6 contains perspective and cross-sectional views of one means of removably securing the hair dryer of FIG. 1 to a wall.
Figure 7:
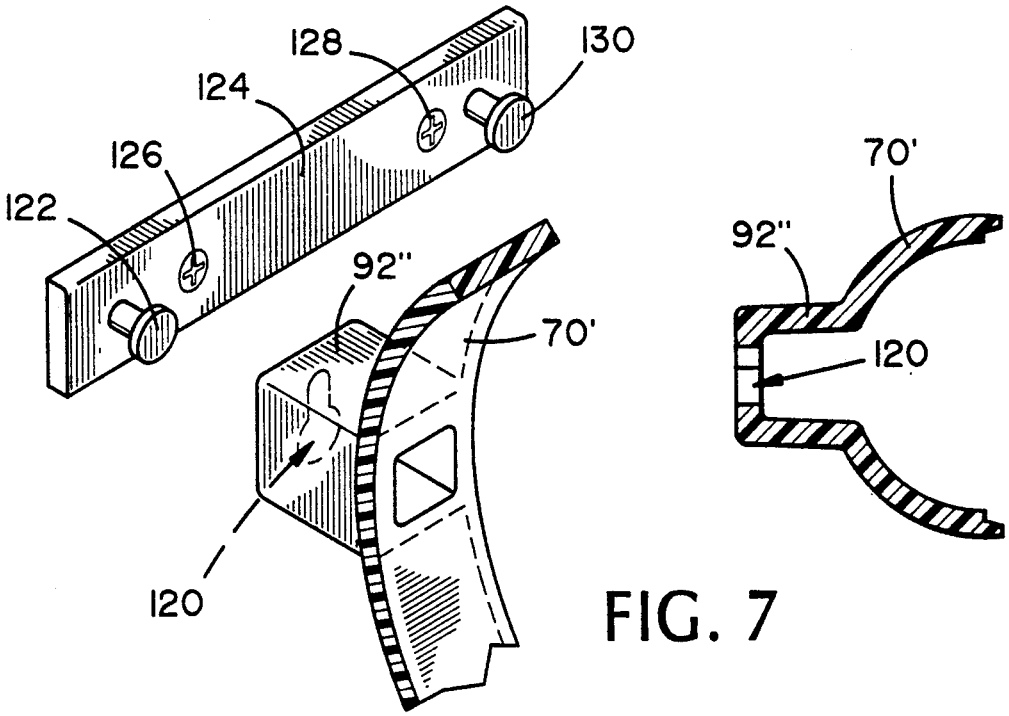
FIG. 7 contains perspective and cross-sectional views of another means of removably securing the hair dryer of FIG. 1 to a wall.

Reference now to FIGS. 6 and 7 will aid in understanding how hair dryer 20 may be removably secured to a wall.

On FIG. 6, a bracket member 92' has formed thereon a downwardly facing hook 100 which is releasably insertable in a first socket 102 on a wall bracket 104 attachable to a wall (not shown) by means of fasteners 105 and 106. It will be understood that a second bracket member 94' (not shown) will have a similar hook for insertion in a second socket 108 on wall bracket 105.

On FIG. 7, a bracket member 92'' has defined therein a keyslot 120 into which is releasably insertable a first T-stud 122 on a wall bracket 124 attachable to a wall (not shown) by means of fasteners 126 and 128. It will be understood that a second bracket member 94'' (not shown) will have a similar keyslot for insertion thereinto of a second T-stud 130 on wall bracket 124.

Figure 8:
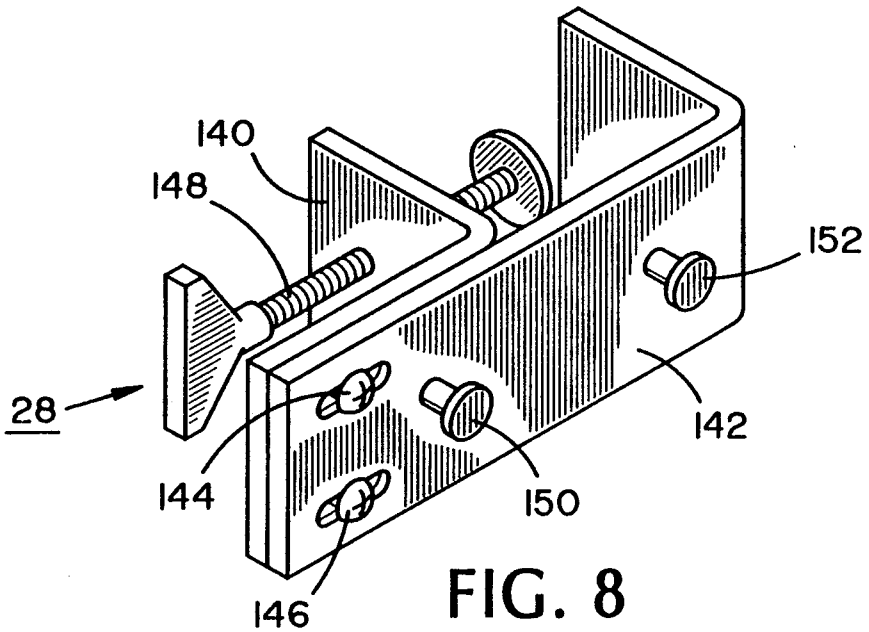
FIG. 8 is a perspective view of a door mount bracket for the hair dryer of FIG. 1.

FIG. 8 depicts door mount bracket 28 (also FIG. 1) which may be employed to releasably mount hair dryer 20 (FIG. 1) to door 26 (FIG. 1, not shown on FIG. 8). Door mount bracket 28 includes first and second L-shaped members 140 and 142, respectively, with respective parallel lower and upper portions, the distance between the lower portions being selectively adjustable to accommodate doors of different thicknesses. Door mount bracket 28 is adjustable by means of by thumb screw 148 to accommodate different door thicknesses. Door mount bracket 28 is shown as having T-studs 150 and 152 for releasably mounting thereon hair dryer 20, in the manner indicated on FIG. 7, but the arrangement shown of FIG. 6 may be provided instead, if desired. Door mount bracket 28 may be attached also to a vanity, a bookcase, or a similar article.

Bracket members 92', 94', 92'', and 94'' are configured so that body 24 (FIGS. 1 and 5) is spaced apart sufficiently from a wall or door to provide for safety and access to the controls and, in the case of a wall mount, to provide for unimpeded air intake flow.

If desired, the mounting arrangements shown of FIGS. 6–8 may be configured so that dryer 20 (FIG. 1) may be disposed vertically on a door or wall rather than horizontally.

Brackets 105 and 124 must be sufficiently rigid to support dryer 20 and, in particular, to withstand the loads imposed when positionable hose 30 is continually adjusted and may be constructed of formed steel plate or other suitable material of sufficient strength.

Figure 9:
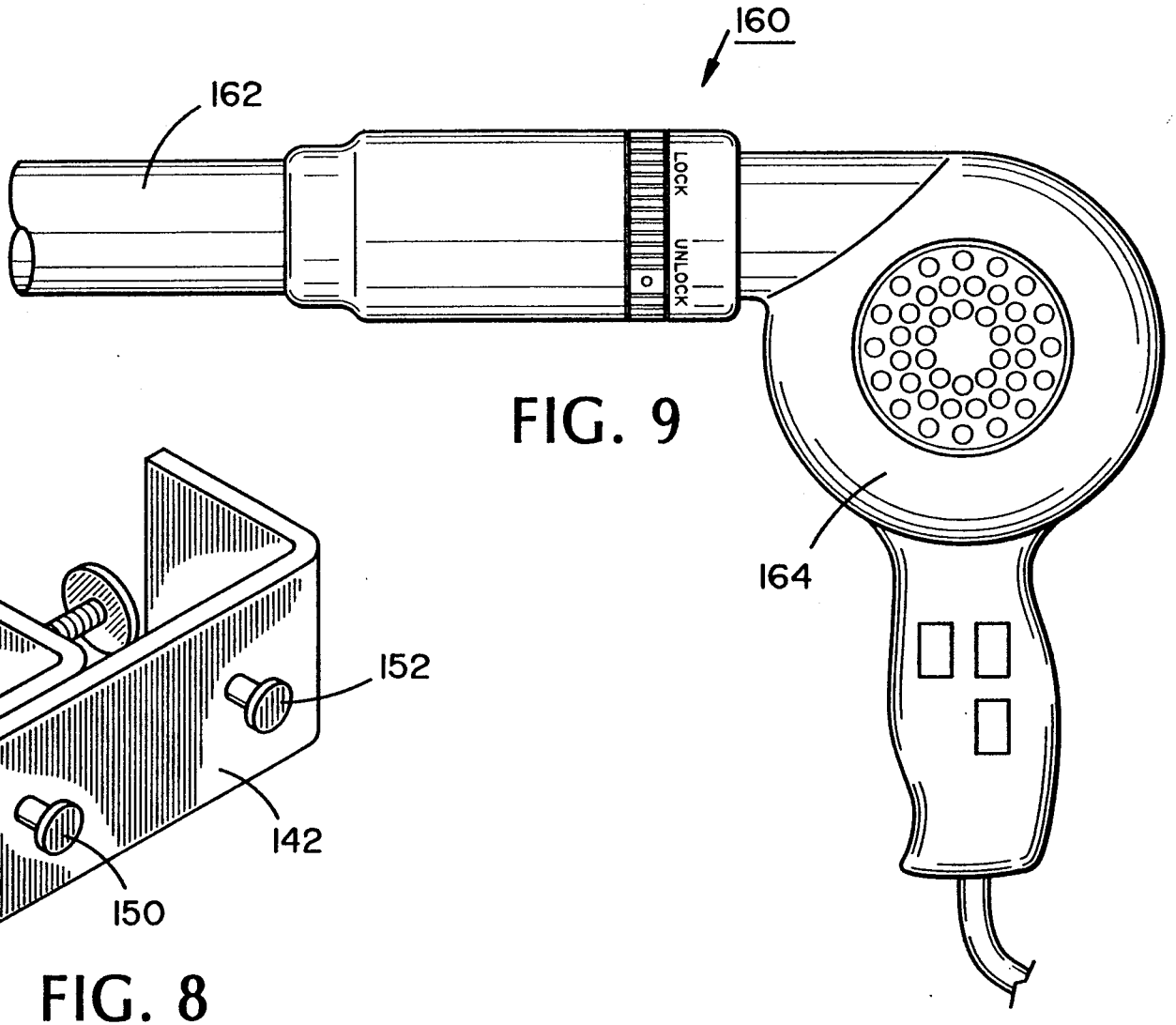
FIG. 9 is a fragmentary, side elevational view of an embodiment of the present invention for use as an accessory with a conventional hand held hair dryer.

Referring now to FIG. 9, there is shown an embodiment of the present invention in the form of an accessory unit, generally indicated by the reference numeral 160. Accessory unit 160 includes, attached to the proximal end thereof, a hose member 162, which may be any of the hoses shown on FIGS 2–4 having the same function as described with reference to FIG. 1. Into the distal end of accessory unit 160 is shown inserted the outlet nozzle of a conventional hand held hair dryer 164.

Figure 10:
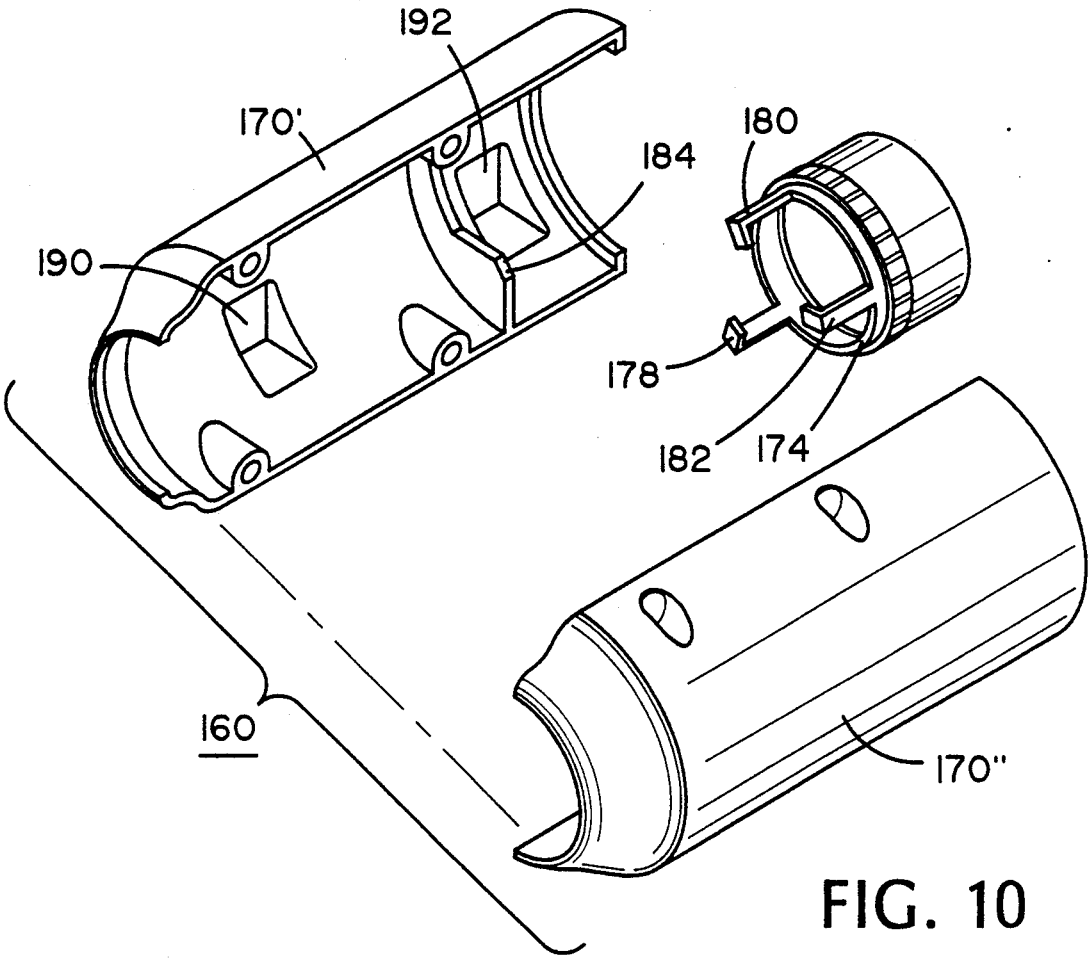
FIG. 10 is a fragmentary, exploded perspective view of the embodiment of FIG. 9.
Figure 11:
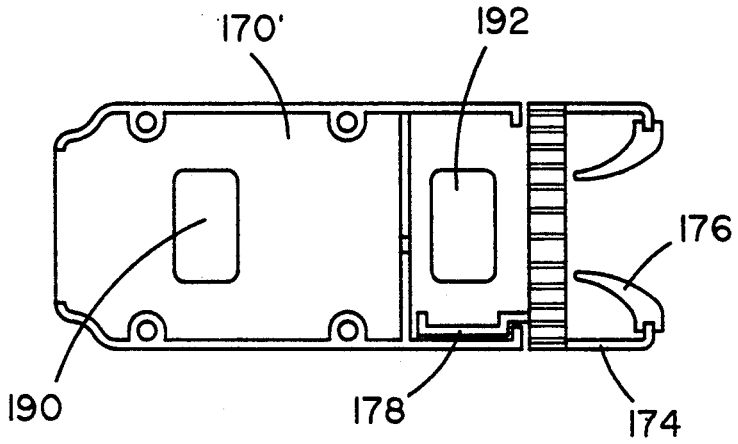
FIG. 11 is a side elevational view of one body half of the embodiment of FIG. 9.

Referring now to FIGS. 10 and 11, accessory unit 160 includes a cylindrical housing 170 formed by injection molded plastic body halves 170' and 170''. Accessory unit 160 further includes an injection molded plastic cam retention member 174 having mounted at the distal end thereof an annular, resilient air seal 176 to seal around the outlet nozzle of hair dryer 164 (FIG. 9). Cam retention member 174 has three compliant gripping fingers 178, 180, and 182 (only gripping finger 178 shown on FIG. 11) which are urged toward the center axis of housing 170 as the cam retention member is rotated within the housing by means of three, corresponding, integral cam surfaces 184 (FIG. 10) (only one shown) formed on the inner periphery of the housing. Rotating cam retention member 174 approximately 60 degrees from the unlocked to the locked positions squeezes gripping fingers 178, 180, and 182 in a collet type fashion, thus gripping and retaining the outlet nozzle of dryer 164. A relatively high degree of compliance of gripping fingers 178, 180, and 182 is required, since the output tube diameters of hair dryers vary among different models. Dryer 164 (FIG. 9) can thus be releasably captured and held by accessory unit 160 without any other support for the dryer.

Body half 170' includes bracket members 190 and 192, the function of which is identical to bracket members 92 and 94 shown on FIG. 5, for the mounting of accessory unit 160 on a door or a wall.

In use, accessory unit 160 is mounted to a door or to a wall, the outlet nozzle of hair dryer 164 (FIG. 9) is inserted into the accessory unit and secured therein by cam retention member 174. The resulting assembly is used in the same manner as hair dryer 20 shown on FIG. 1.

Figure 12:
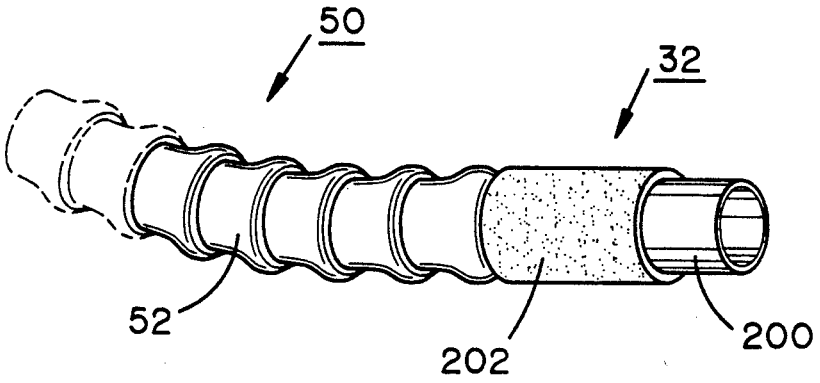
FIG. 12 is a perspective view of the end fitting of FIG. 1.

FIG. 12 shows the details of end fitting 32 (FIG. 1). End fitting 32 terminates in a straight, smooth tubular portion 200 which may be used for the attachment thereto of standard hair styling accessories. Surrounding a part of tubular portion 200 is a cylindrical section of an insulating closed-cell foam rubber grip 202 for convenient and safe positioning of end fitting 32. Such a material is furnished by GripWorks, St. Louis, Mo. End fitting 32 is shown as being attached to the distal end of hose 52 (FIG. 3), but the end fitting may be used with any style of hose. End fitting 32 may be used with either hair dryer 20 (FIG. 1) or with accessory unit 160 (FIG. 9).

Figure 13:
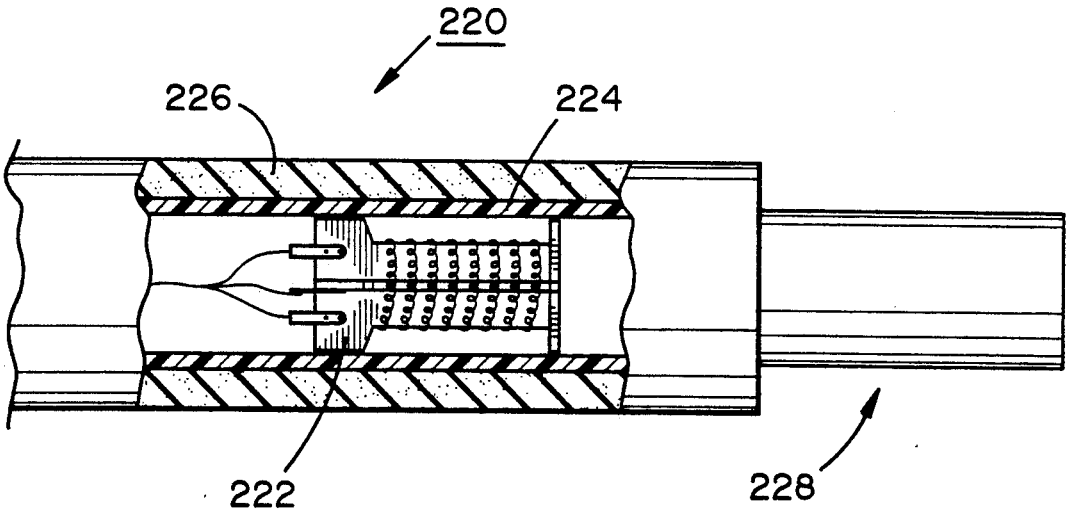
FIG. 13 is a fragmentary, side elevational view, partially in cross-section, of an alternative embodiment of the hair dryer of FIG. 1.

FIG. 13 illustrates an alternative end fitting for hair dryer 20 (FIG. 1), the end fitting being generally indicated by the reference numeral 220, in which there is disposed a heating element/thermal cutout 222, rather than having the heating element/thermal cutout disposed in body 24. An advantage of this embodiment is that only end fitting 220 is hot which obviates the need to provide any insulating arrangement for hose 30 and many permit a greater selection of materials of construction for the hose, since, in this case, the hose is carrying only relatively cool air. Here, heating element/thermal cutout 222 is disposed within a straight length of plastic tubing 224 encased in a closed-cell foam rubber grip 226. Plastic tubing 224 terminates in an unencased portion 228 for the attachment thereto of hair styling accessories.

Where not otherwise specified and/or obvious, the components of the present invention can be easily and economically manufactured by conventional injection molding of suitable thermoplastic materials.

It will be understood that hair dryer 20 (FIG. 1) and accessory unit 160 (FIGS. 9–11) are easily transported and, in the case of the door mount embodiment of FIG. 1, can be easily temporarily set up in a hotel room or the like.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. A hands free hair dryer unit, comprising:

(a) a generally hollow body;

(b) an inlet opening defined in the distal end of said body for the entrance thereinto of air;

(c) an elongate, infinitely positionable, hollow hose having its proximal end attached to the proximal end of said body and having its distal end selectively positionable;

(d) said hollow hose being self-supporting such that, once positioned, said hair dryer unit may be employed for the drying of hair without the distal end of said hollow hose or an intermediate portion thereof being attached to separate supporting structure or touched by the user of said hair dryer unit during said drying of hair; and (e) said hollow hose being selected from the group consisting of: (1) a hose comprising a flexible skin with an internal, helical wire disposed against and supporting said skin, and a relatively rigid, but bendable, rod disposed within said hose and extending between said body and said distal end of said hose to make said hose selectively positionable and self-supporting; (2) a hose comprising a plurality of snapped together links rotatably attached together in a ball-and-socket relationship, the interference fit of said balls and said sockets together with the frictional characteristics of the material of construction thereof providing sufficient frictional resistance to impart selectively positionable and self-supporting characteristics to said hose; and (3) a hose comprising an elongate strip helically wound in edge-abutting relationship to form said hose, one edge of said strip having a flange extending outwardly therefrom along the length thereof and the other edge of said strip having a receptacle defined therein, said flange and said receptacle being interlockable to secure said strip in helically wound relationship and having sufficient frictional resistance to make said hose selectively positionable and self-supporting.

2. A hands free hair dryer, as defined in claim 1, wherein said hair dryer unit is adapted to be completely supported by the mounting of said body to a rigid structure.

3. A hands free hair dryer unit, as defined in claim 1, wherein said hair dryer unit is adapted to be supported by the releasable mounting of said body to a wall.

4. A hands free hair dryer unit, as defined in claim 1, wherein said distal end of said hose includes an externally smooth, straight tubular portion for the attachment thereto of hair styling accessories.

5. A hands free hair dryer unit, as defined in claim 1, wherein said inlet end of said body is adapted for the insertion thereinto of the outlet nozzle of a conventional hand held hair dryer, said conventional hand held hair dryer being supported by said body.

6. A hands free hair dryer unit, as defined in claim 5, further comprising means to releasably lock said outlet nozzle of said conventional hand held hair dryer in said body.

7. A hands free hair dryer unit, as defined in claim 1, further comprising a fan and a heater unit disposed within said body to supply a flow of hot air from said distal end of said hose.

8. A hands free hair dryer unit, as defined in claim 1, further comprising:

(a) a fan disposed in said body to supply a flow of air from said distal end of said hose; and (b) a heater unit disposed in said distal end of said hose to heat said air.

9. A hands free hair dryer unit, as defined in claim 1, wherein said hair dryer unit is adapted to be supported by the releasable mounting of said body to the edge of a door.

* * * * *